US011051596B2

(12) United States Patent
Choquette

(10) Patent No.: US 11,051,596 B2
(45) Date of Patent: Jul. 6, 2021

(54) NECK CHAIN HOLDER

(71) Applicant: Rene N Choquette, Warwick, RI (US)

(72) Inventor: Rene N Choquette, Warwick, RI (US)

( * ) Notice: Subject to any disclaimer, the term of this patent is extended or adjusted under 35 U.S.C. 154(b) by 0 days.

(21) Appl. No.: 17/007,506

(22) Filed: Aug. 31, 2020

(65) Prior Publication Data

US 2020/0397108 A1 Dec. 24, 2020

Related U.S. Application Data

(60) Provisional application No. 63/050,070, filed on Jul. 9, 2020.

(51) Int. Cl.
*A45C 11/00* (2006.01)
*A45C 11/16* (2006.01)
*A44C 11/00* (2006.01)

(52) U.S. Cl.
CPC ..... *A45C 11/16* (2013.01); *A44C 11/00* (2013.01); *A45C 11/00* (2013.01)

(58) Field of Classification Search
CPC ..... B65H 2701/3911; B65H 75/04; B65H 75/28; B65H 75/285; B65H 75/406; A45C 11/16; A45C 11/00; A47F 7/005; A47F 7/02; A47F 7/022; A47F 7/03; B65D 1/36
USPC ..... 206/6.1, 37, 348, 517, 566; 242/172, 242/402, 404.2, 400.1, 579, 580
See application file for complete search history.

(56) References Cited

U.S. PATENT DOCUMENTS 673,091 A * 4/1901 Shepard ..... G11B 15/674 242/586.2
2,102,446 A * 12/1937 Wallace ..... B41J 33/003 242/586.2
3,870,245 A * 3/1975 Witteborg, Jr. .... A01K 89/0111 242/309
4,120,394 A * 10/1978 Soltes ..... A45C 11/16 206/19
4,461,383 A * 7/1984 Groff ..... A47F 7/03 206/566
4,856,070 A * 8/1989 Britton, Sr. ..... H04R 1/08 381/366
2003/0154579 A1* 8/2003 Disher ..... B43M 99/001 24/462
2004/0200332 A1* 10/2004 Chen ..... B65H 49/205 83/648

(Continued)

*Primary Examiner* — Jack W Lavinder
(74) *Attorney, Agent, or Firm* — Barry Choobin; Patent 360

(57) ABSTRACT

The present invention is directed to a holder for a chain and in particular a jewelry chain, such as a neck chain. The holder includes a spool and a clip. The spool includes a core body having an outer surface, a proximal end, and a distal end. A first flange extends upwards from the proximal end of the core body, the first flange having an inner side and an outer side. A second flange extends upwards from the distal end of the core body, the second flange having an inner side and an outer side. A pin upstands from the outer surface of the core body, wherein, the inner side of the first flange and the inner side of the second flange are in face to face relation. The outer surface of the core body, the inner side of the first flange, and the inner side of the second flange are continuous and form a spooling region. The clip configured to fit onto the spoon and prevent slipping of the clip from the edges of the flanges.

2 Claims, 4 Drawing Sheets

(56) References Cited

U.S. PATENT DOCUMENTS

| | | | | |
|---|---|---|---|---|
| 2005/0050918 | A1* | 3/2005 | Saintil-van Goodman | A44C 11/00 63/3.2 |
| 2007/0108333 | A1* | 5/2007 | Kuramoto | H02G 11/02 242/395 |

* cited by examiner

NECK CHAIN HOLDER

FIELD OF INVENTION

The present invention generally relates to a holder for jewelry, and in particular, the present invention relates to a holder for storing a chain and like jewelry.

BACKGROUND

Chains are the most used and generic form of jewelry. Made from metal, a chain is typically a series of intertwined links. Mostly worn in the neck and so also known as neck chains. But, can also be worn around other parts of the body, such as around the arm. The chains can be worn as such or may have additional accessories hooked to the chain. For example, the charms are popular to be hook with the neck chains for adding the aesthetic appearance of the chains.

Thus, a need is appreciated for a holder of a chain, that can keep the chain in a tidy manner and the chain can be easily carried in a purse or pocket without tanging in the chain.

SUMMARY OF THE INVENTION

The principal object of the present invention is therefore directed to a holder for Jewelry chain, that can prevent tangling of a jewelry chain while storage or transportation.

It is a further object of the present invention that the holder is easy to use.

It is an additional object of the present invention that the holder is compact in dimension for easy handling, storage, and transport.

It is another object of the present invention that the holder can be easily carried in a purse, clutch, and like.

It is still another object of the present invention that the holder is economical to manufacture.

It is a further object of the present invention that the holder can hold the neck chain in a tidy manner.

In one aspect, the present invention directs to a holder for chains, and in particular, the neck chains. The holder comprises a spool and a clip. The spool is having a core body, wherein the core body is having an outer surface, a proximal end, and a distal end. A first flange that extends upwards from the proximal end of the core body, the first flange having an inner side and an exterior side. A second flange that extends upwards from the distal end of the core body, the second flange having an inner side and an outer side. The inner side of the first flange and the inner side of the second flange faces each other. The outer surface of the core body, the inner side of the first flange, and the inner side of the second flange are continuous and forms a spooling region. A pin that upstands from the outer surface of the core body can hook the chain.

In one aspect, the holder includes a clip. The clip is configured to removably engage with the spool and function to prevent unwinding of the chain that is wound around the spool.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

FIG. 4 shows a portion of the chain wound around the spool, according to an exemplary embodiment of the present invention.

DETAILED DESCRIPTION

Figure 1:
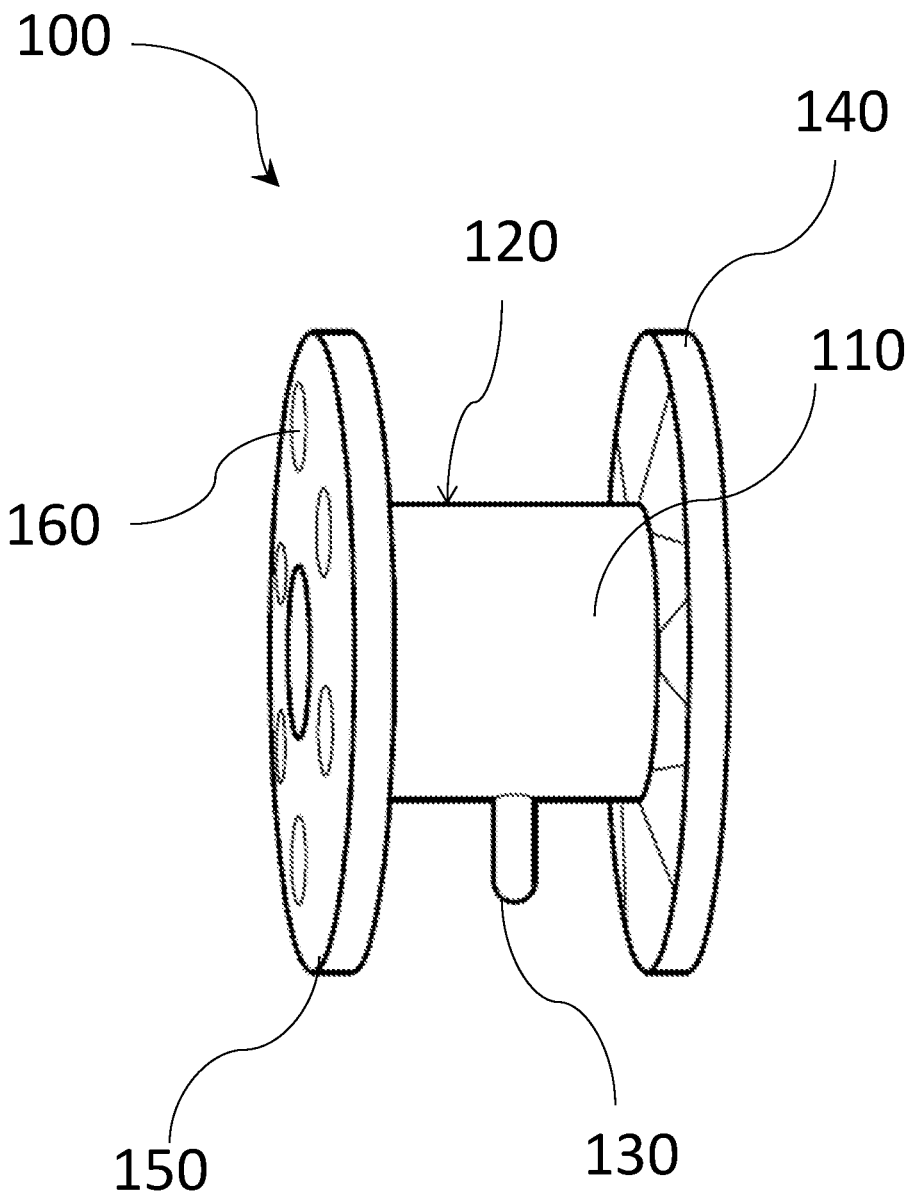
FIG. 1 shows a spool, according to an exemplary embodiment of the present invention.

Subject matter will now be described more fully hereinafter. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as devices and methods of use thereof. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

The following detailed description is described with reference to the drawings, wherein like reference numerals are used to refer to like elements throughout. In the following description, for purposes of explanation, specific details may be set forth in order to provide a thorough understanding of the subject innovation. It may be evident, however, that the claimed subject matter may be practiced without these specific details.

The present invention is directed to a holder for storing a chain in a tidy manner and preventing the tangling of the chain. The chain can be a jewelry chain made of metal, alloys, ceramics, plastics, fiber, beads, and like material. The chain can be a series of links intertwine together. The chain can also be a series of beads intertwine together. Also, the chain can be a continuous fiber strand. The chain may or may not have additional accessories, such as a charm or pendant. Now, referring to FIG. 1, which shows an exemplary embodiment of the spooler 100. The spooler 100 is shown to have a cylindrical core body 110 resembling a drum with two axial ends, referred herein as the proximal end and the distal end. The core body is having an outer round surface 120. A pin 130 can also be seen projecting upwards from the outer surface 120. The pin 130 is shown of a short length and having a rounded blunt tip. In use, the chain hooks to the pin, thereafter, the chain can be wound around the spool. To the sides of the core, the body can be providing a pair of flanges. FIG. 1 shows a first flange 140 that extends perpendicular from the proximal end of the core body 110. The flange 140 can also be a round plate that is coupled to the periphery of the cylindrical core body. Alternatively, the flange can be continuous with the core body and extends upwards. The flange can have an inner side and an outer side.

Similar, to the flange 140 is the second flange 150 that extends from the distal end of the cylindrical core body. The second flange 150 also has an inner side and the outer side. The inner side of the first flange 140 and the inner side of the second flange 150 in face-to-face relation and perpendicular to the outer surface of the core body 120, which is shown as a cylindrical core body. The inner side of the first flange, the outer surface of the core body, and the inner side of the second flange are continuous and forms the spooling region. It is to be understood that the opposite flanges of the spool are shown perpendicular to the core body, however, the flanges can be at an angle more than 90 degrees as long as the chain wound around the spool does not slip from the spool. Moreover, the flanges can be curved to provide an aesthetic appearance to the holder. The holder can be manufactured as a single piece. Alternatively, the flanges can be coupled to the periphery of the core body. Also, it is to be understood that the core body is shown to be having a cylindrical drum-like configuration. However, the cylindrical body can be having three or more edges, such as the core body can be of a rhombus shape.

The flange 150 is also shown to have a plurality of apertures 160 arranged in a circular path. These apertures are optional, the flange can be solid without these apertures. Apertures and like elements can also be provided for aesthetic purposes. In one case, the apertures 160 can be used to fix a clip to the spool. The apertures can be replaced by protrusions for provided a snap-fitting the clip to the spool.

Figure 2:
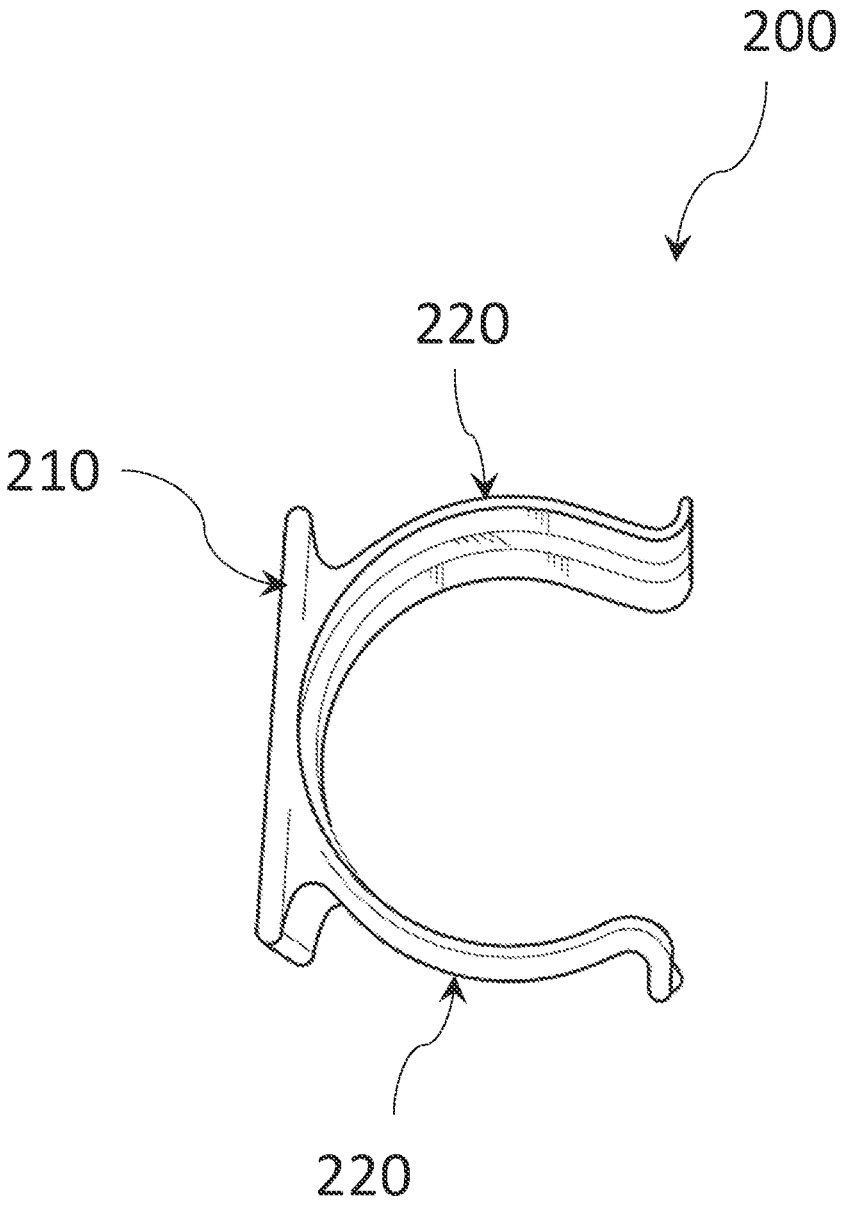
FIG. 2 shows a clip, according to an exemplary embodiment of the present invention.

FIG. 2 shows the clip 200 configured to be snap-fit onto the spool shown in FIG. 1. The clip 200 is having a flat base 210 that allows the holder to be placed on a flat surface. From the base extends a pair of curved arms 220, such as the pair of curved arms face each other. The clip 200 is dimensioned to fit around the holder i.e. over the edges of the left flange and the right flange. The arms of the clip can be manufactured of a resilient material that allows the clip to slide over and snap-fit onto the spool. The inner surface of the arms of the clip can also be configured with ribs that prevent the clip from sliding over the spool. For example, the inner surface of the arms can be including a circular rib 225 that is positioned to be adjacent the edges of the arms, such that when the clip is fit onto the spool, the ribs prevent linear motion of the clip over the spool.

Figure 3:
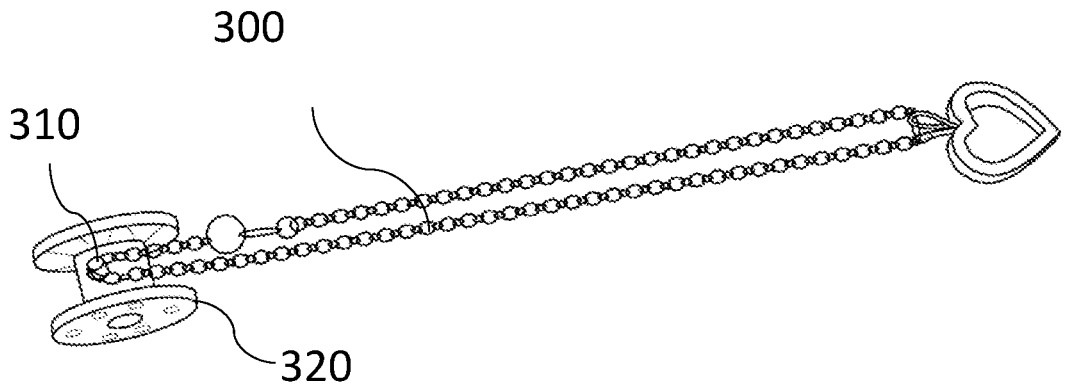
FIG. 3 shows the spool having a chain hook to the pin of the spool, according to an exemplary embodiment of the present invention.
Figure 4:
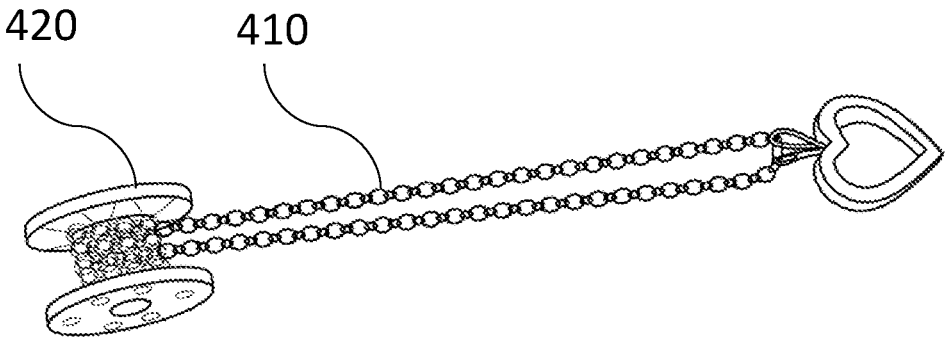
FIG. 4 shows a portion of the chain winded, according to an exemplary embodiment of the present invention.
Figure 5:
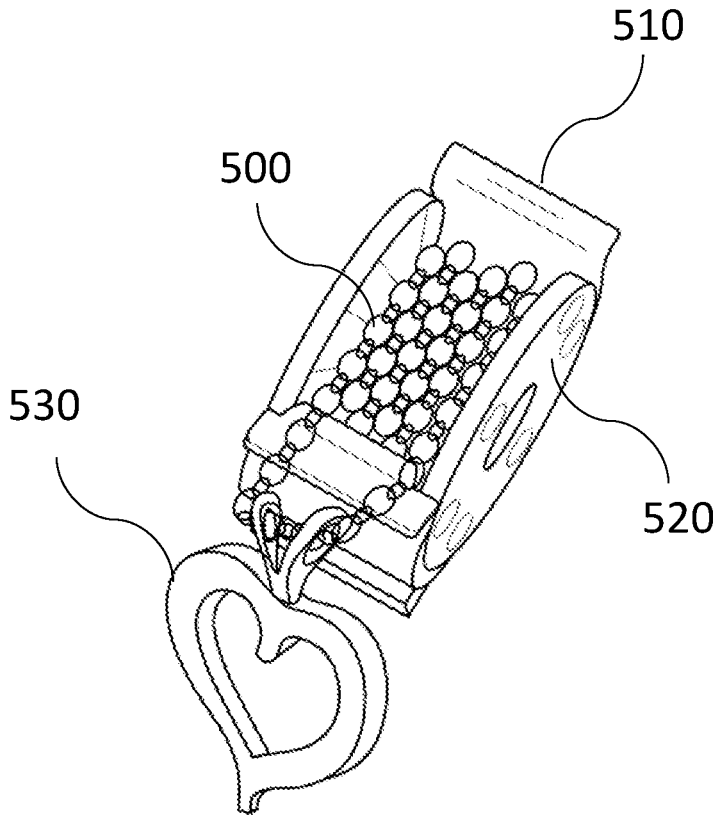
FIG. 5 shows the clip coupled to the spool and a charm of the chain that extends from the chain, according to an exemplary embodiment of the present invention

FIG. 3 shows a chain 300 hook to the pin 310 of the spool 320. Once the chain hooks to the clip, a slight tension can be maintained in the chain to prevent the chain from flip over the pin, thereafter the chain can be wound around the spool 320. FIG. 4 shows a portion of the chain would around the spool. In case, the chain is having a charm, also shown in FIGS. 3 and 4, the necklace can be kept at an end while the chain is wound round around the spool. When the chain is completely wound around the spool, the clip can be fit onto the spool. FIG. 5 shows the holder having the chain 500, wherein the clip 510 is clipped to the spool 520. In case the chain is having a charm 530, the charm remains extended as shown in FIG. 5.

The purpose of the clip is to prevent the chain from unwinding the spool. The clip can be engaged to the outer side of the flanges as well, The clip may also have a pin like a protuberance that can fit onto the pin of the core body. This may provide additional stability to the clip and prevent slipping or loosening of the chain.

FIG. 1 also shows the core body as hollow, i.e. having an axial aperture. The axial aperture is also optional but could be used for mounting the holder. In one case, a flexible cord can pass through the aperture and the holder could be hung using the cord. The axial apertures can also be used to mount multiple holder side-by-side to a hanger.

The holder disclosed herein can be made of metal or plastic material and is of a compact configuration that can be easily carried. It can be manufactured by 3D printing, molding, injection molding, or any similar procedure.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A method for storing and transporting a chain, the method comprises:

providing a holder, the holder comprises:

a spool, the spool comprises:

a core body having an outer surface, a proximal end, and a distal end;

a first flange extending upwards from the proximal end of the core body, the first flange having an inner side and an outer side, a second flange extending upwards from the distal end of the core body, the second flange having an inner side and an outer side, a pin upstands from the outer surface of the core body, wherein, the inner side of the first flange and the inner side of the second flange are in face-to-face relation, wherein the outer surface of the core body, the inner side of the first flange, and the inner side of the second flange are continuous and form a spooling region, a clip configured to fit onto the spool;

hooking a chain to the pin;

wounding around the chain over the spooling region; and securing the clip onto the spool, wherein the clip is configured to prevent unwinding of the chain from the spool.

2. The method according to claim 1, wherein the clip is having a base, the base having a proximal end and a distal end, a first arm extends upwards from the proximal end of the base, a second arm extends from the distal end of the base, the first arm and the second arm are in face to face relation, wherein the base and the two arms are dimensioned to fit onto edges of the first flange and the second flange.

* * * * *